US008092275B2

(12) United States Patent
Nguyen

(10) Patent No.: US 8,092,275 B2
(45) Date of Patent: Jan. 10, 2012

(54) ABRASIVE AIR BLAST SYSTEM WITH AIR COOLER FOR BLAST NOZZLE AND AIR DRYER FOR STORAGE TANK

(76) Inventor: Phuong Taylor Nguyen, Richmond, TX (US)

( * ) Notice: Subject to any disclaimer, the term of this patent is extended or adjusted under 35 U.S.C. 154(b) by 308 days.

(21) Appl. No.: 12/378,388

(22) Filed: Feb. 14, 2009

(65) Prior Publication Data

US 2010/0210191 A1 Aug. 19, 2010

(51) Int. Cl.
*B24C 7/00* (2006.01)

(52) U.S. Cl. ..... 451/7; 451/75

(58) Field of Classification Search ..... 451/90, 451/75, 99, 38, 39, 40, 7
See application file for complete search history.

(56) References Cited

U.S. PATENT DOCUMENTS 2,953,875 A * 9/1960 Mead ..... 451/75
5,239,788 A * 8/1993 Woodson ..... 451/39
5,412,910 A * 5/1995 Woodson et al. ..... 451/38
5,441,441 A * 8/1995 Cook et al. ..... 451/36

* cited by examiner

*Primary Examiner* — Robert Rose

(57) ABSTRACT

An abrasive blaster system includes a storage tank for storing dry granular abrasive media, a source of pressurized air and a metering valve for mixing the granular abrasive media with the pressurized air for release through a blast nozzle. A cooling system is in line with the source of pressurized air for cooling the air received from the source before it is introduced to the metering valve, whereby cooled air is introduced into the metering valve. The system also includes a dryer system downstream of the cooling system and adapted for selectively receiving a portion of the cooled air for further drying it. The dryer system is in communication with the storage tank, whereby cooled, dry air is introduced into the storage tank.

14 Claims, 3 Drawing Sheets

ABRASIVE AIR BLAST SYSTEM WITH AIR COOLER FOR BLAST NOZZLE AND AIR DRYER FOR STORAGE TANK

BACKGROUND

1. Field of the Invention

The invention is generally related to abrasive airblast systems and is specifically directed to air drying and treatment means for such systems.

2. Discussion of the Prior Art

Abrasive blasting is a well known operation for cleaning or preparing a surface by forcibly propelling a stream of abrasive material against it. Abrasive blasting systems have been around for over a century, with an early blasting processed patented by Benjamin Chew Tilghman on Oct. 18, 1870. In such operations the abrasive material is made up of small granular or particulate matter which is introduced into a pressurized air stream for dry blasting or a fluid for wet blasting.

Dry abrasive blasting applications are typically powered from an air compressor and are known as airblast systems. Most applications involve a pressurized vessel that contains the abrasive and meters it into the compressed air stream, primarily by gravity flow.

Typical pressure blast or airblast systems provide for the feed of abrasive media to be controlled independently of blast pressure. The abrasive media is generally not recycled in open air systems and must be continually supplied during an operation. In this type of system the abrasive media is stored in a hopper or pot and is fed into the nozzle air stream from the hopper in a separate air stream. The separate air stream primarily is used to fill the void caused in the hopper as, the abrasive material gravity flows out of the hopper and into the blast stream.

The blasting equipment usually consists of but is not limited to a hand-held nozzle that directs a stream of the granular abrasive media particles toward a work surface or a work piece. The media flows from the hopper into a mixing chamber in order to transport the media to the nozzle where it is subject to a high velocity air stream that propels it toward the work.

Moisture in the compressed, pressurized air causes the granular abrasive inside the airblast system to "clump" and not flow or not flow consistently. An airblast system requires abrasives to flow consistently for optimum performance. If the "clumping" is excessive the granular abrasive will not gravity flow from the hopper into the mixing chamber and will result in an intermittent flow, causing an inconsistent surface finish. An airblast system requires abrasives to gravity flow consistently for optimum performance.

Currently, compressed air is treated with a compressed air cooler or a compressed air dryer. The air cooler typically consists of an air cooled radiator or heat exchanger to utilize ambient air to cool the hotter compressed air. Then the air is further treated with an apparatus to remove the resulting condensation from cooling the compressed air. In the prior art there are two preferred methods for moisture removal. In the first system, the condensate droplets are first removed from the air stream via centrifugal force. The air is introduced tangentially into a knockout tank to induce centrifugal motion. Second, the compressed air flows through a coalescing pad that will trap moisture droplets. At this point the compressed air has been cooled and virtually all of the moisture is removed.

In the second system a dryer is used to remove the moisture. The most prevalent dryer is a deliquescent dryer. In a typical system the deliquescent dryer has the same elements as the air cooler with the addition of a deliquescent bed. After the air is cooled and moisture removed, the compressed air flows through a deliquescent bed which will remove water vapor to achieve a relative humidity of 55%. This equates to approximately 20° F. dew point suppression. For example, if the compressed air is cooled to 115° F., the deliquescent bed will remove enough water vapor to achieve a relative humidity of 55% or a dew point of 95° F. This means that the compressed air has to further cool below 95° F. degrees for condensation to form.

In prior art systems, the blast units are either connected to air coolers or to dryers. During blasting, 99% of the air consumption is for the blast nozzle(s) and 1% goes to the pressure vessel or abrasive hopper. This 1% is basically to fill the volume of the abrasive that has drained out of the vessel or hopper for blasting. However, the 1% of air that goes into the hopper is required to be much dryer than the 99% of air that flows through the nozzle. This is because once the abrasive mixture enters the nozzle flow line the propulsion force and speed of particle flow is such that "clumping" is not an issue.

The prior art systems typically equally treat and dry all of the air flowing through the system even though only 1% is required to be at an elevated dry condition.

SUMMARY OF THE INVENTION

The present invention is directed to an improved cooling and drying apparatus and method for an airblast abrasive system. The abrasive blaster system of the subject invention includes a storage tank for storing dry granular abrasive media, a source of pressurized air and a metering valve for mixing the granular abrasive media with the pressurized air for release through a blast nozzle. A cooling system is in line with the source of pressurized air for cooling the air received from the source before it is introduced to the metering valve, whereby cooled air is introduced into the metering valve. The system also includes a dryer system downstream of the cooling system and adapted for selectively receiving a portion of the cooled air for further drying it. The dryer system is in communication with the storage tank, whereby cooled, dry air is introduced into the storage tank.

More specifically, the abrasive blaster system is of the type for delivering a mixture of dry granular abrasive particles stored in a storage vessel and pressurized air through a blast nozzle. The system includes a cooler for cooling the pressurized air to a predetermined temperature for reducing the dew point from the dew point of the air at the source. The cooled air is then introduced into a distribution system such as an aftercooler vessel. A dryer is in communication with the distribution system and the storage vessel for further drying the cooled air. A release system discharges a first volume of cooled air to the blast nozzle and a second volume of air to the dryer. The dryer further dries the cooled air and introduces it into the storage vessel. Typically, the first volume of cooled air is approximately 99% of the air introduced into the distribution system, and the second volume of cooled air is approximately 1% of the air introduced into the distribution system.

In the subject invention all of the compressed air is cooled in a manner sufficient to satisfy the requirements for the pressurized air flowing through the nozzle. Only the small percentage of air that flows into the hopper or vessel is dried. This provides a higher level of dry air flowing into the vessel and insures proper abrasive flow. The system of the subject invention provides optimum air conditioning while at the same time significantly reducing the costs associated with drying the air for the vessel.

In a system utilizing an active drier such as, by way of example, a deliquescent bed, the consumption of the deliquescent medium is approximately 1% of that used in prior art systems with no loss in functionality. Specifically, by drying the air where it is most needed and more importantly, by not drying the air where it is not needed, substantial increase in system efficiency is achieved. Further, since the compressed air treatment system of the subject invention is drying a much lower volume flow rate, the size of the drying capacity is reduced proportionately. These advantages should equate to lower operating cost and lower equipment cost of the airblast system.

In the preferred embodiment of the invention, the source of compressed air is introduced into a typical air cooler such as a radiator system. This cools the air to approximately 95° F. The cooled air is then introduced into an aftercooler vessel for distribution. Approximately 99% of the cooled air flows from the aftercooler vessel through the blast nozzle in well known manner. Approximately 1% of the air in the aftercooler vessel flows into and through a dryer system for further treatment to reduce the dew point to acceptable levels prior to introducing the dried air into the abrasive storage vessel. The abrasive media is introduced into the blast air stream from the vessel through an abrasive metering valve in the well known manner.

The resulting airblast system provides a flow through the blast nozzle which is consistent with prior art systems while greatly reducing the costs associated with drying the compressed air which is introduced into the vessel for assuring continuous flow of abrasive through the abrasive metering valve.

An exemplary embodiment of the invention is described in detail herein in accordance with the following drawings and description.

DETAILED DESCRIPTION OF THE PREFERRED EMBODIMENT

Figure 1:
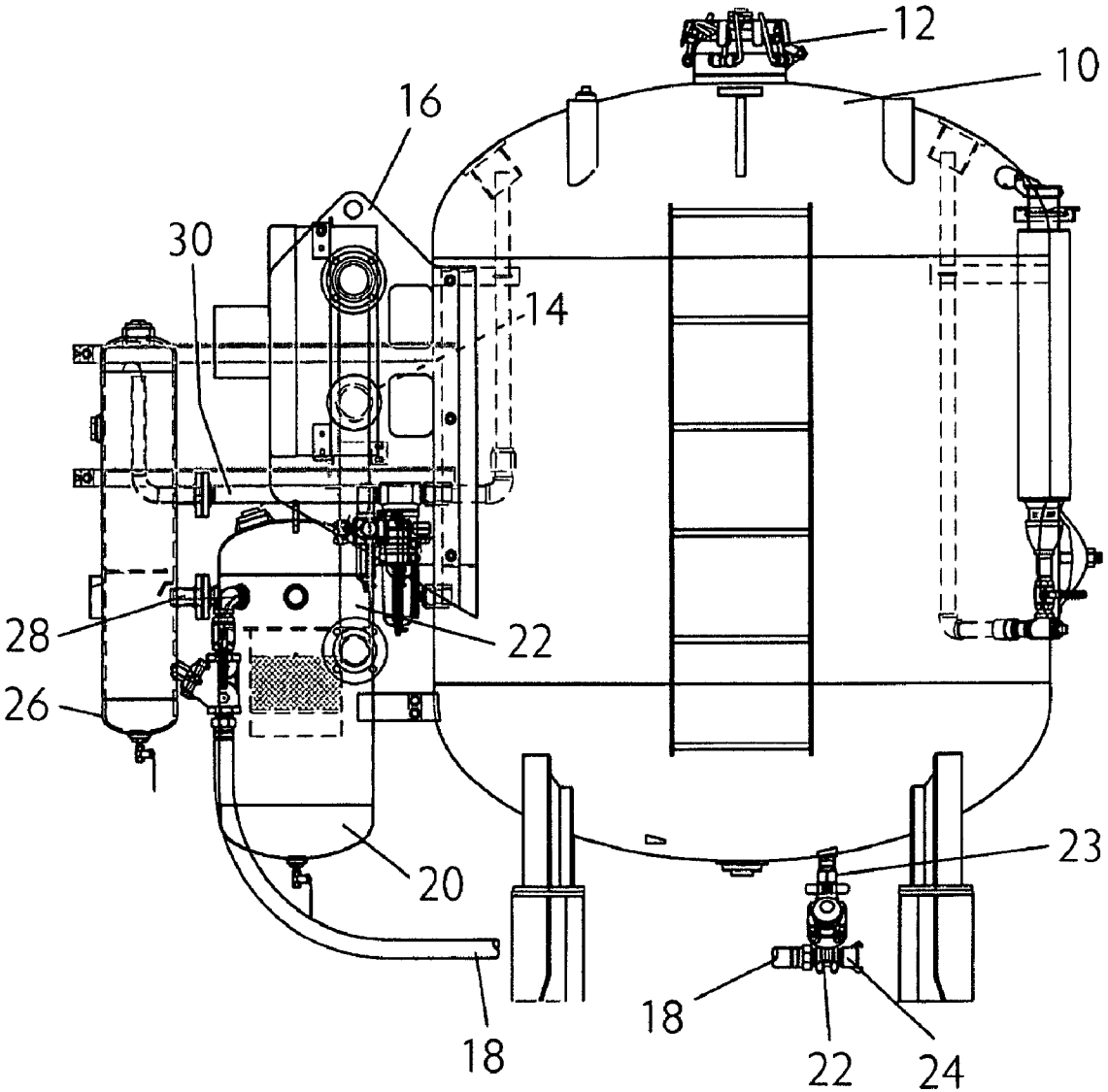
FIG. 1 is a side view of an airblast system incorporating the cooling and drying system of the subject invention.
Figure 2:
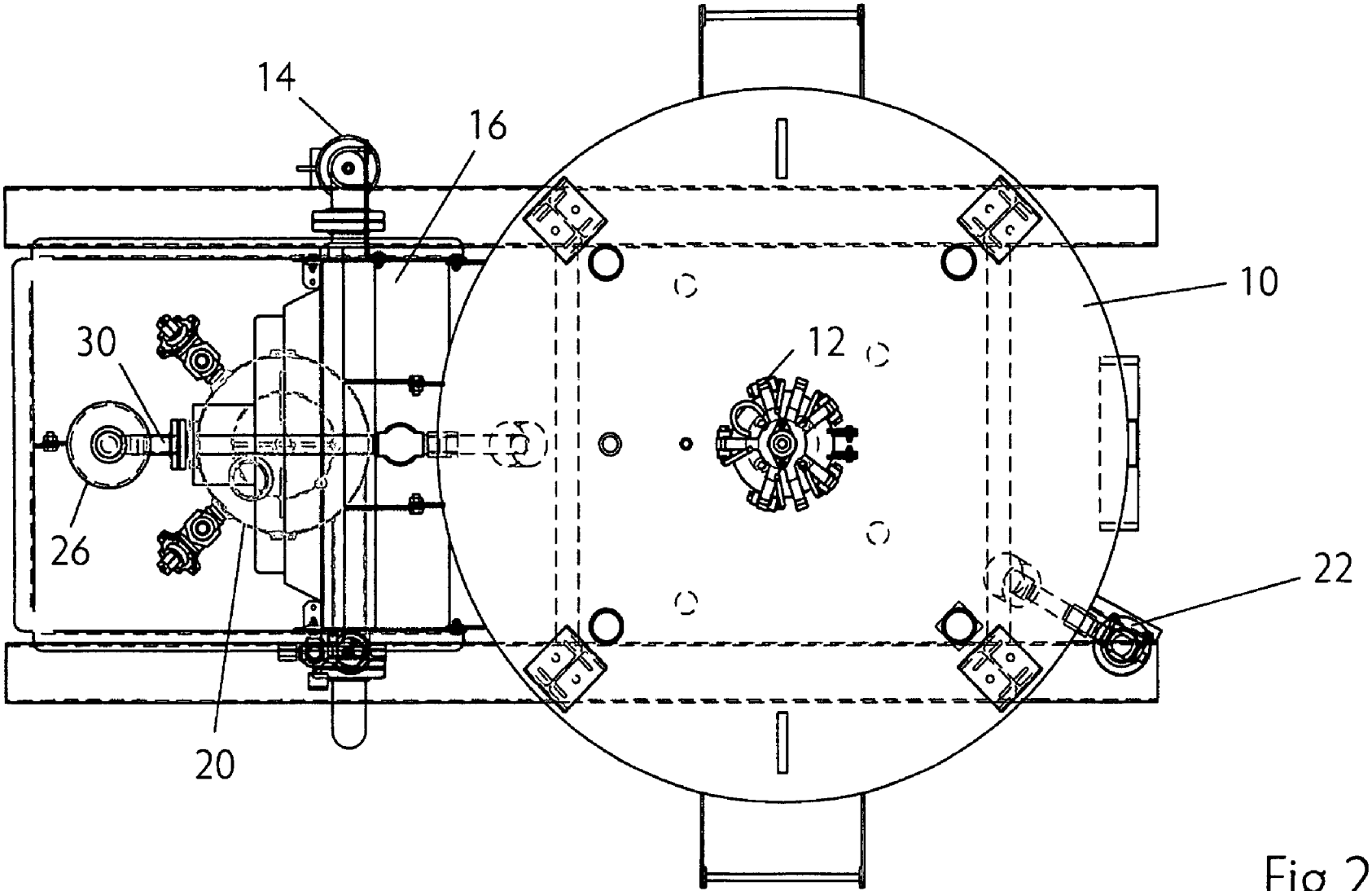
FIG. 2 is a top view of the airblast system of FIG. 1.

As shown in FIGS. 1 and 2, a typical airblast system includes a hopper or vessel 10 for housing the granular abrasive media which is introduced through the hatch 12 provided in the top of the vessel. Pressurized air is provided from an external source (not shown) at port 14. The pressurized air is cooled, typically by a radiator-type cooling system 16.

In a typical system, the pressurized air is cooled to approximately 95° F., or to within about 20° F. of ambient temperature to assure that the dew point is sufficiently lowered to provide uninterrupted flow through the blast line 18. The radiator cooled air flows from the cooling system 16 into an aftercooling vessel 20 via a flow line 22. The cooled air is then released from the aftercooling vessel 20 into a blast line 18 where it is mixed with abrasive media released from the hopper 10 via line 23 at an abrasive metering valve 22. The high flow air and abrasive mixture are then delivered to a blast nozzle (not shown) via the release line 24.

A small volume of the cooled air introduced into the aftercooling vessel 20, typically about 1%, is introduced into a dryer system 26 via line 28. This air is then subjected to further treatment to reduce the dew point to acceptable levels prior to introducing the dried air into the abrasive storage vessel via line 30. This assures that only dry air is introduced into the vessel for further assuring that the abrasive media flowing from the vessel into the metering valve remains dry and is not prone to "clumping."

In the preferred embodiment the drier system 26 is a dryer using a deliquescent bed for treating the air. By placing the dryer downstream of the cooling system 16 and by drying only the small volume of air which is to be introduced into the vessel 10 the costs associated with the drying function are greatly reduced without sacrificing any performance.

Figure 3:
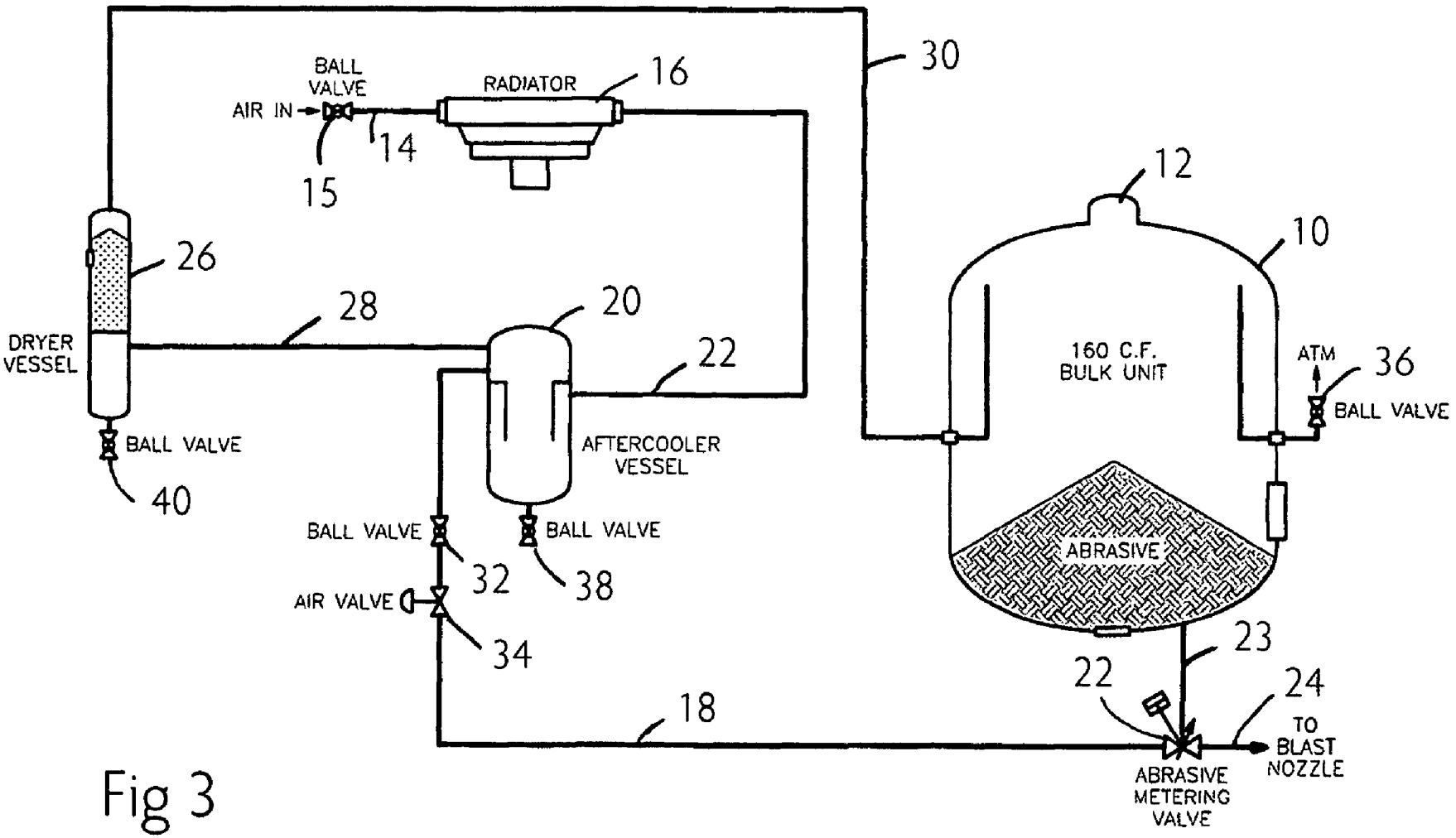
FIG. 3 is a schematic diagram of the flow system of the invention.

A schematic diagram of a system in accordance with the subject invention is shown in FIG. 3, and is consistent with the system illustrated in FIGS. 1 and 2. As there shown, the source of compressed, pressurized air is introduced into the system via line 14, typically through a ball valve 15. The air is cooled at a cooling unit such as, by way of example, the passive radiator system 16, and then is introduced into a distribution system such as the aftercooler vessel 20 via line 22.

The greater volume of air, approximately 99%, is released into the blast line 18, where it is mixed with abrasive at the abrasive metering valve 22 as the abrasive is introduced into the metering valve 22 from the hopper 10 via line 23. The abrasive, high volume air mixture is then discharged to a blast nozzle (not shown) via line 24.

Typically, a ball valve 32 and air control valve 34 are provided for controlling the flow of high volume air from the aftercooler vessel into the blast line 18. As is standard in most airblast systems, all of the pressure tanks include ball valve release valves for depressurizing the system. As shown, ball valve 36 is associated with hopper 10, ball valve 38 is associated with aftercooler vessel 20 and ball valve 40 is associated with the dryer vessel system 26.

While the invention as shown and described utilizes a radiator-type, passive cooling system 16 and a deliquescent type dryer 26 the invention will function in a similar manner with any cooling system and dryer system combination chosen as a matter of choice or as dictated by the specific application. By way of example, other cooling system types include, but are not limited to refrigerated coolers. By way of example, other drying systems include, but are not limited to desiccant dryers.

While certain embodiments and features of the invention have been described in detail herein, it should be understood that the invention include all modifications and enhancements with the scope and spirit of the following claims.

What is claimed is:

1. An abrasive blaster system of the type for delivering a mixture of dry granular abrasive particles stored in a storage vessel and pressurized air through a blast nozzle, comprising:

a. a source of pressurized air;

b. a cooler for cooling the pressurized air to a predetermined temperature for reducing the dew point from the dew point of the air at the source;

c. a distribution system for receiving the cooled air;

d. a dryer in communication with the distribution system and the storage vessel for further drying the cooled air;

e. a release system for releasing a first volume OT cooled air to the blast nozzle and a second volume of air to the dryer, and f. wherein the distribution system comprises an after cooling vessel for receiving the cooled air from the cooler.

2. The abrasive blaster system of claim 1, wherein the dryer includes a deliquescent media.

3. The abrasive blaster system of claim 1, wherein the cooler is a passive radiator-type cooler in line with the source of pressurized air.

4. The abrasive blaster system of claim 1, wherein the first volume of cooled air is approximately 99% of the air introduced into the distribution system.

5. The abrasive blaster system of claim 1, wherein the second volume of cooled air is approximately 1% of the air introduced into the distribution system.

6. An abrasive blaster system of the type having a storage tank. for storing dry granular abrasive media, a source of pressurized air and a metering valve for mixing the granular abrasive media with the pressurized air for release through a blast nozzle, the system further comprising:

a. a cooling system for cooling the pressurized air received from the source before it is introduced to the metering valve, whereby cooled air is introduced into the metering valve;

b. a dryer system downstream of the cooling system and adapted for selectively receiving a portion of the cooled air for further drying it, the dryer system in communication with the storage tank, whereby cooled, dry air is introduced into the storage tank; and c. an air distribution system between the cooling system and the metering valve, wherein a first portion of air introduced into the distribution system from the cooling system is released to the metering valve and a second portion of air introduced into the distribution system is released to the dryer system, and wherein the distribution system is an aftercooler vessel.

7. The abrasive blaster system of claim 6, wherein the cooling system is a passive radiator-type system in line with the source of pressurized air.

8. The abrasive blaster system of claim 6, wherein the dryer system includes a deliquescent media.

9. The abrasive blaster system of claim 6, wherein the first volume of cooled air is approximately 99% of the air introduced into the distribution system.

10. The abrasive blaster system of claim 6, wherein the second volume of cooled air is approximately 1% of the air introduced into the distribution system.

11. An abrasive blaster system of the type for delivering a mixture of dry granular abrasive particles stored in a storage vessel adapted for gravity feeding the abrasive particles into a metering valve for mixing the abrasive particles with pressurized air for release of the particle/air mix through a blast nozzle, comprising:

a. a source of pressurized air;

b. a radiator-type cooler in line with the source of pressurized air for cooling the pressurized air to a predetermined temperature for reducing the dew point from the dew point at the air at the source;

c. an aftercooler vessel in line with then system for receiving the cooled air;

d. a release system for releasing a first volume of cooled air to the blast nozzle and a second volume of air to the dryer; and e. a dryer in communication with the aftercooler vessel and the storage vessel for further drying a second portion the cooled air and introducing it into the storage vessel.

12. The abrasive blaster system of claim 11, wherein the dryer includes a deliquescent media.

13. The abrasive blaster system of claim 11, wherein the first volume of cooled air is approximately 99% of the cooled air introduced into the aftercooling vessel.

14. The abrasive blaster system of claim 11, wherein the second volume of cooled air is approximately 1% of the cooled air introduced into the aftercooling vessel.

* * * * *